United States Patent [19]

Mukunoki et al.

[11] 4,388,402

[45] Jun. 14, 1983

[54] PHOTOGRAPHIC LIGHT-SENSITIVE MATERIAL

[75] Inventors: Yasuo Mukunoki, Minami-ashigara; Yasuhiro Nakayama, Fujinomiya; Shigeki Yokoyama, Minami-ashigara, all of Japan

[73] Assignee: Fuji Photo Film Co., Ltd., Kanagawa, Japan

[21] Appl. No.: 292,082

[22] Filed: Aug. 12, 1981

[30] Foreign Application Priority Data

Aug. 15, 1980 [JP] Japan ..... 55-112416

[51] Int. Cl.[3] ..... G03C 1/06; G03C 1/38; G03C 1/84

[52] U.S. Cl. ..... 430/527; 430/529; 430/531; 430/533; 430/536; 430/629; 430/631; 430/634; 430/630

[58] Field of Search ..... 430/527–530, 430/627, 631, 634, 636, 630, 533, 536, 531, 629

[56] References Cited

U.S. PATENT DOCUMENTS

| | | | |
|---|---|---|---|
| 3,681,070 | 8/1972 | Timmerman et al. | 430/538 |
| 3,791,831 | 2/1974 | von Bonin | 430/539 |
| 3,861,924 | 1/1975 | Mackey et al. | 430/628 |
| 4,147,550 | 4/1979 | Campbell et al. | 430/529 |
| 4,267,265 | 5/1981 | Sugimoto et al. | 430/527 |

FOREIGN PATENT DOCUMENTS

| | | | |
|---|---|---|---|
| 1518085 | 3/1968 | France | 430/627 |
| 815662 | 7/1959 | United Kingdom | 430/529 |

*Primary Examiner*—Mary F. Downey
*Attorney, Agent, or Firm*—Sughrue, Mion, Zinn, Macpeak and Seas

[57] ABSTRACT

A photographic light-sensitive material is described comprising a support having thereon a silver halide emulsion layer, said material including at least one hydrophilic colloid layer containing at least 0.1 g/m$^2$ of a water-soluble polymer having a molecular weight of from 10,000 to 500,000 and consisting essentially of a repeating unit represented by formula (I)

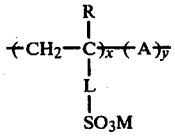

(I)

wherein R represents a hydrogen atom, a halogen atom, or an alkyl group; L represents a single chemical bond or a divalent connecting group; M represents a hydrogen atom, an ammonium ion, or an alkali metal ion; X represents from 10 to 100 mol%; y represents from 0 to 90 mol%; and A represents a copolymerized monomer unit derived from a copolymerizable ethylenically unsaturated monomer.

The photographic light-sensitive material has improved antistatic properties without damaging other photographic properties.

19 Claims, No Drawings

PHOTOGRAPHIC LIGHT-SENSITIVE MATERIAL

BACKGROUND OF THE INVENTION

The present invention relates to a photographic light-sensitive material, and, more particularly, to a silver halide photographic light-sensitive material having improved antistatic properties by the presence of a specific water-soluble polymer.

The antistatic property of a material relates, in general, to surface resistivity and charge. Reduced surface resistivity and a small charge are desired and it is also requested that these properties do not deteriorate with the passage of time.

A photographic light-sensitive material generally comprises a support such as film of a poly-α-olefin (e.g., polyethylene, polystyrene, etc.), cellulose ester (e.g., cellulose triacetate, etc.), polyester (e.g., polyethylene terephthalate, etc.), paper, synthetic paper, or a paper sheet coated on both sides with polymeric materials, having coated on one side or both sides light-sensitive photographic emulsion layer (or layers) with an interposed subbing layer provided to strongly adhere the support to the photographic emulsion layers, and, if desired or necessary, various layers constituting photographic light-sensitive materials such as interlayers, protective layers, a backing layer, an antihalation layer, or the like, in various combinations.

Examples of a photographic light-sensitive material having a photographic emulsion coated on both sides of a support include, for example, X-ray film for direct use. Most other photographic light-sensitive materials are coated only on the one side with a photographic emulsion.

Therefore, the latter type of photographic materials have a photographic emulsion-free surface, i.e., the surface of the support, usually called the "backing" side. Since photographic light-sensitive materials comprise a support and photographic layers having an insulating property, electrostatic charges are liable to be generated and accumulated during the production of photographic light-sensitive materials and during use thereof due to contact friction with or delamination from the surface of the same or different substances. This accumulated electrostatic charge can cause many difficulties. For example, in the photographic film before development processing, the light-sensitive emulsion layer will respond to the discharge of the accumulated electrostatic charge to form dot-like spots or tree-like or feathery linear patterns after developing the photographic film, which spots or patterns are ordinarily called static marks. Such marks seriously deteriorate, or, in some cases, completely spoil the commercial value of photographic films. For example, it can easily be seen that static marks appearing in X-ray film for medical or industrial use could lead to extremely dangerous misdiagnosis. The existence of this phenomenon is confirmed only after development, and is therefore an extremely difficult problem. In addition, the accumulated electrostatic charge can cause adhesion of dust on the film surface, and secondary problems such as formation of non-uniform coatings or the like.

As is described above, such electrostatic charge often accumulates upon production of photographic light-sensitive materials and upon use. For example, in production, electrostatic charges are generated through contact friction between the photographic film and rollers or separation between the support surface and the emulsion-coated surface in steps involving winding of photographic films. Also, with finished products, electrostatic charges are generated by delamination of a base surface from an emulsion-coated surface when winding of the photographic film is conducted in a humidity high enough to cause film adhesion, or by the contact and delamination of X-ray film from mechanical parts in an automatic processing machine or from a fluorescent sensitizing paper. In addition, it may also be generated by contact with a wrapping material. Static marks of photographic light-sensitive materials to be formed by the accumulation of such electrostatic charge become much greater as the sensitivity of the photographic light-sensitive material is increased and as the speed of processing (processing velocity) is increased.

These frictional charges or delamination charges are considered to be caused by a mutual ionic action between the molecules of contacted substances. However, at present, it is difficult to predict from structural and chemical viewpoints what substance will be negatively charged and what substances will be positively charged.

A solution, however, is to reduce the charge voltage, or to increase electric conductance on the surface of a substance, to thereby release electrostatic charge in an extremely short time before localized discharge due to the accumulation of electric charge can occur, so as to prevent such charging and discharging. Therefore, various processes have been suggested for improving the electroconductivity of the support or various coated surface layers of photographic light-sensitive materials, and various hygroscopic substances, water-soluble inorganic salts, certain kinds of surface active agents, and polymers have been utilized. For example, polymers as described, e.g., in U.S. Pat. Nos. 2,882,157, 2,972,535, 3,062,785, 3,262,807, 3,514,291, 3,615,531, etc., surface active agents as described, e.g., in British Pat. No. 861,134, U.S. Pat. Nos. 2,982,651, 3,428,456, 3,457,076, 3,454,625, 3,552,972, 3,655,387, etc., zinc oxide, semiconductors, colloid silica, etc., as described, e.g., in U.S. Pat. Nos. 3,062,700, 3,245,833, 3,525,621, etc., are known.

Known processes for directly imparting an antistatic property to photographic film supports include processes of directly compounding certain substances in a support of a high molecular weight material, and processes of coating such substances on the surface of the support. In the latter case, an antistatic agent is coated as a backing layer by using it alone or in combination with gelatin, polyvinyl alcohol, cellulose acetate, or a similar polymeric substance.

Also, a process is known for preventing charging of photographic light-sensitive materials by incorporating an antistatic agent in a photographic emulsion layer or a surface protecting layer thereof, or coating a solution of an antistatic agent on the surface of such layers. However, many of these show specificity depending upon the kind of film support or the composition of the photographic materials. Thus, a particular agent providing good results for certain film supports, photographic emulsion layers, or other photographic layers may be useless for antistatic purposes with respect to other different film supports and photographic layers, and, in some cases, exerts a detrimental influence on photographic properties.

In general, with high speed emulsions there are few antistatic agents which provide satisfactory antistatic effects under conditions of low humidity (about 30% relative humidity (RH)). In many cases, a reduction in antistatic effects and an increase in adhesion problems occur under conditions of high temperature and high humidity. In particular, with light-sensitive materials wherein a photographic emulsion is coated on both sides of a support (such as X-ray light-sensitive materials), it has been difficult to discover effective antistatic agents.

Further, it has been particularly difficult to establish stable antistatic properties, since in many cases antistatic properties which have been granted tend to decrease with the passage of time or due to friction.

Also, in the case of searching for antistatic agents for photographic light-sensitive materials, it is necessary to take into consideration the sensitivity, fog, granularity, sharpness, and other photographic properties, as well as the points of maintaining a suitable friction constant, and of not deteriorating camera behavior, i.e., characteristics of light-sensitive materials observed when the light-sensitive materials move within a camera, e.g., slipperiness at the time of loading or feeding films in the camera, or adhesion resistance.

For a certain compound to achieve the intended effect as an antistatic agent, it is generally required that the compound be incorporated in a photographic light-sensitive material in a greater amount than when it is used for other purposes (for example, as a coating aid, an emulsifying agent, or a sensitizing agent). This is presumably because an antistatic agent must form a continuous layer in order to remain electrically conductive in a photographic layer. However, when the antistatic agent is used in such a great amount, much of it remains on the surface of a light-sensitive material, causing various problems in the preparation or use of the light-sensitive material, since it may be transferred to transport rollers, the camera, or X-ray screen that contact the surface of the light-sensitive material. For instance, an antistatic agent transferred to a transport roll may stain the roll, and the stain may be deposited on a film that subsequently passes between the rolls. If the antistatic agent is transferred from an X-ray film to a screen, the characteristics of the screen may be changed, or a stain or blur may be formed on the X-rayed photographic material. This not only impairs the product quality, but may result in an inaccurate diagnosis. Thus, it is very difficult to apply antistatic agents to photographic light-sensitive materials, and the selection of antistatic agents is very restricted as described above.

SUMMARY OF THE INVENTION

Therefore, one object of the present invention is to provide a photographic light-sensitive material having an improved antistatic property without harming other photographic properties.

Another object of the present invention is to provide a photographic light-sensitive material having reduced surface resistivity and small charge and keeping these properties with the passage of time.

It has been found that these objects can be attained by a photographic light-sensitive material comprising a support having thereon a silver halide emulsion layer, said material having at least one hydrophilic colloid layer containing at least 0.1 g/m$^2$ of a water-soluble polymer having a molecular weight of from 10,000 to 500,000 and consisting essentially of a repeating unit represented by formula (I)

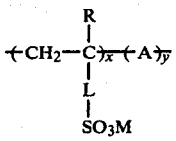

(I)

wherein R represents a hydrogen atom, a halogen atom or an alkyl group; L represents a single chemical bond or a divalent connecting group; M represents a hydrogen atom, an ammonium ion, or an alkali metal ion; x represents from 10 to 100 mol%; y represents from 0 to 90 mol%; and A represents a copolymerized monomer unit derived from a copolymerizable ethylenically unsaturated monomer.

DETAILED DESCRIPTION OF THE INVENTION

In formula (I), the divalent connecting group represented by L includes, for example, an arylene group, preferably having from 6 to 10 carbon atoms, an arylene-alkylene group, preferably having from 7 to 12 carbon atoms, an alkylene group, preferably having from 1 to 6 carbon atoms, —COOR$_1$—, or —CONH-R$_1$—, wherein R$_1$ represents an alkylene group, an arylene group, or an arylenealkylene group as described above.

Examples of copolymerizable ethylenically unsaturated monomers from which the unit represented by A is derived include, for example, an ethylenically unsaturated monocarboxylic acid or dicarboxylic acid such as acrylic acid, methacrylic acid, itaconic acid, etc., an ester of an ethylenically unsaturated monocarboxylic acid or dicarboxylic acid such as methyl methacrylate, n-butyl acrylate, cyclohexyl methacrylate, etc., an ethylenically unsaturated ester of a monoaliphatic acid such as vinyl acetate, allyl acetate, etc., styrene, α-methylstyrene, acrylonitrile, acrylamide, methacrylamide, N-vinyl pyrrolidone, ethylene, propylene, and a diene such as butadiene, isoprene, etc.

Of these monomers, acrylic acid, methacrylic acid, methyl methacrylate, styrene, acrylamide, and N-vinyl pyrrolidone are particularly preferred.

In formula (I), A may contain not only one, but also two or more of the monomer units described above.

Specific examples of the water-soluble polymers having a repeating unit represented by formula (I) according to the present invention will be set forth below, but the present invention is not limited thereto.

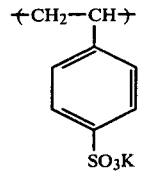

A-1

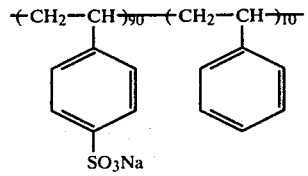

A-2

-continued

A-3

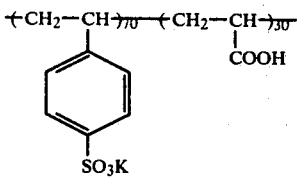

A-4

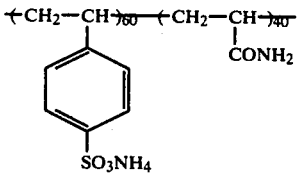

A-5

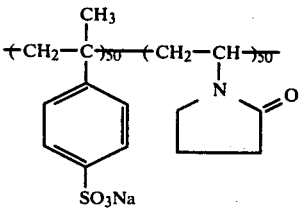

A-6

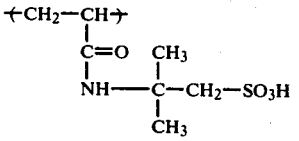

A-7

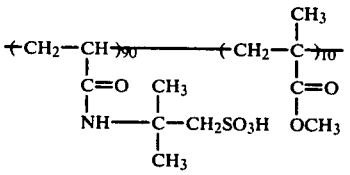

A-8

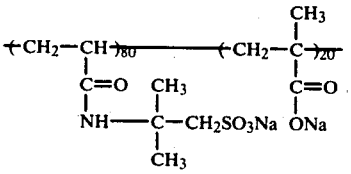

A-9

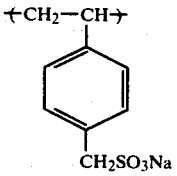

A-10

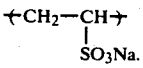

A preferred amount of the water-soluble polymer having a repeating unit represented by formula (I) used in the present invention ranges from 0.1 g/m$^2$ to 1.0 g/m$^2$. The water-soluble polymer is preferably added to a light-sensitive silver halide emulsion layer or a layer adjacent thereto. If the amount added is less than 0.1 g/m$^2$, the desired effect cannot be obtained, and if the amount added is more than 1.0 g/m$^2$, coating of the hydrophilic layer containing the polymer may be difficult.

Some of water-soluble polymers having a repeating unit represented by formula (I) are known as viscosity increasing agents for a hydrophilic colloid layer, as described in Japanese patent publication No. 3582/60. However, such polymers are used for the purpose of increasing viscosity according to Japanese Patent Publication No. 3582/60, and are high molecular weight polymers which have a viscosity of from 1 to 20 centipoise measured at a temperature of 30° C. in a 0.1% aqueous solution thereof, and the amount added is substantially restricted in order to coat the hydrophilic colloid layer under stable conditions. Therefore, it is impossible to reduce the surface resistivity to the desired range using such high molecular weight polymers.

As a result of extensive studies, it has been found according to the present invention that (1) it is necessary to add the polymer having sulfonic acid groups in an amount of at least 0.1 g/m$^2$, preferably from 0.1 g/m$^2$ to 1.0 g/m$^2$, in order to reduce the surface resistivity to the desired range, (2) in order to add the polymer having sulfonic acid groups in the amount of 0.1 g/m$^2$ to 1.0 g/m$^2$, a weight average molecular weight of the polymer must be 500,000 or less, otherwise the viscosity of the coating solution for coating is too high and causes degradation of coating properties, and (3) when polymers having the weight average molecular weight less than 10,000 are used, the surface resistivity cannot be reduced to the desired range.

The surface resistivity of photographic light-sensitive materials can be sufficiently reduced by using a polymer having the repeating unit represented by formula (I). However, in some cases a reduction solely in the surface resistivity is not sufficient for achieving a satisfactory improvement in antistatic properties of photographic light-sensitive materials.

In such cases, it is preferable to use a water-soluble polymer according to the present invention in combination with an organic fluoro-compound represented by formula (II)

$$(Cf)(Y)_n \qquad \text{(II)}$$

wherein (Cf) represents an n-valent group containing at least three fluorine atoms and at least three carbon atoms; n represents an integer of 1 or 2; and (Y) represents a group selected from

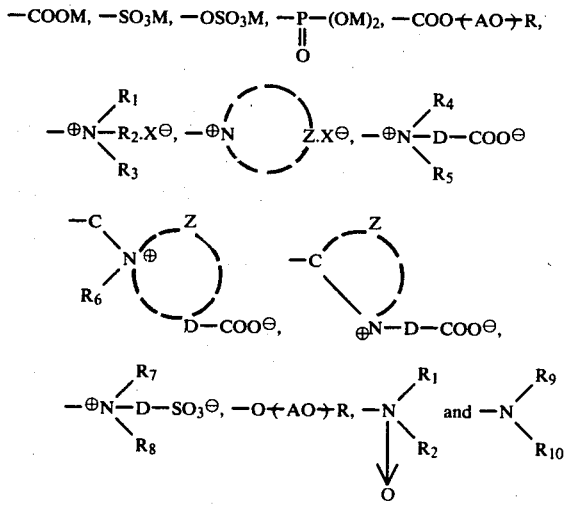

wherein M represents a hydrogen atom, a cation such as an alkali metal atom, an alkaline earth metal atom, a quaternary ammonium base, etc., or a hydrocarbon group having from 1 to 18 carbon atoms; $-(AO)-$ represents a polyalkylene oxide group having a degree of polymerization of from 2 to 100 and selected from polyoxyethylene, polyoxypropylene and a (polyoxyethylene-polyoxypropylene) block copolymer; R represents a hydrogen atom, an alkyl group having from 1 to 18 carbon atoms, for example, a methyl group, an ethyl group, a butyl group, an octyl group, a dodecyl group, etc., or an aryl group, for example, a phenyl group, a naphthyl group, etc.; $R_1$, $R_2$, $R_3$, $R_4$, $R_5$, $R_6$, $R_7$ and $R_8$ each represents an alkyl group having from 1 to 4 carbon atoms, for example, a methyl group, an ethyl group, a butyl group, etc., or a hydroxyalkyl group, for example, a hydroxymethyl group, a γ-hydroxypropyl group, etc.; $R_9$ and $R_{10}$ each represents a hydrogen atom, an alkyl group having from 1 to 4 carbon atoms, for example, a methyl group, an ethyl group, a sec-butyl group, etc., or a hydroxyalkyl group having from 1 to 4 carbon atoms; X represents a halogen atom, for example, a chlorine atom, a bromine atom, an iodine atom, etc., or an $R-O-SO_2-O^{\ominus}$ group wherein R has the same meaning as defined above; Z represents an atom or an atomic group necessary to form a 5- or 6-membered ring, for example, a pyrrole ring, an imidazoline ring, an oxazole ring, a pyridine ring, a pyrimidine ring, etc., together with the N atom; and D represents an alkylene group having from 1 to 5 carbon atoms.

The compounds represented by formula (II) which can be used in the present invention can be synthesized by the methods as described, for example, in U.S. Pat. Nos. 2,559,751, 2,567,011, 2,732,398, 2,764,602, 2,806,866, 2,809,998, 2,915,376, 2,915,528, 2,934,450, 2,937,098, 2,957,031, 3,472,894, 3,555,089, 3,589,906, 3,666,478, 3,754,924, 3,775,126 and 3,850,640, British Patent No. 1,330,356, Japanese patent publication No. 37304/70, Japanese Patent Application (OPI) No. 9613/72 (the term "OPI" as used herein refers to a "published unexamined Japanese patent application"), Japanese Patent Application No. 18090/80, J. Chem. Soc., page 2789 (1950), ibid., page 2574 (1957), ibid., page 2640 (1957), J. Amer. Chem. Soc., Vol. 79, page 2549 (1957) and J. Japan Oil Chemists Soc., Vol. 12, page 653.

Typical examples of compounds represented by formula (II) are set forth below.

$C_7F_{15}COOH$ B-1

$C_6F_{13}(CH_2)_{10}COONa$ B-2

$H(CF_2)_{10}COONH_4$ B-3

$H(CF_2)_8OCH_2CH_2CH_2SO_3Na$ B-4

$C_8F_{17}SO_3K$ B-5

$C_8F_{17}SO_2-N(C_3H_7)-CH_2COOK$ B-6

$NaO_3S-CH(CH_2COOCH_2(CF_2)_6H)-COOCH_2(CF_2)_6H$ B-7

$NaO_3S-CH_2-CH(CH-COOCH_2(CF_2)_6H)-COOCH_2(CF_2)_6H$ B-8

$NaO_3S-CH_2-CH(CH_2-COOC_8H_{17})-COOCH_2(CF_2)_6H$ B-9

-continued $C_{16}H_{33}-CH(SO_3Na)-COOCH_2(CF_2)_7H$ B-10

$C_8F_{17}SO_2-N(C_3H_7)-(CH_2CH_2)_{11}OCH_2CH_2CH_2SO_3Na$ B-11

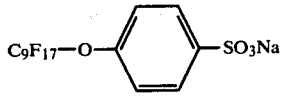

B-12

$Cl(CF_2-CFCl)_{13}CF_2COOH$ B-13

$C_8F_{17}SO_2-N(C_3H_7)-CH_2CH_2-O-P(=O)-(OH)_2$ B-14

$H(CF_2)_8CH_2-O-P(=O)-(ONa)_2$ B-15

$C_8F_{15}SO_2-N(C_2H_5)-(CH_2CH_2O)_{11}H$ B-16

$C_8F_{17}COO(CH_2CH_2O)_{20}H$ B-17

$H(CF_2)_7COO(CH_2CH_2O)_9CH_3$ B-18

$C_7F_{15}COO(CH_2CH(OH)-O)_{13}(CH_2CH_2O)_{10}CH_3$ B-19

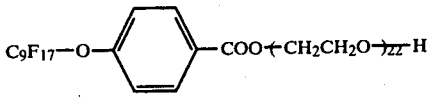

B-20

$C_6F_{11}O(CH_2CH_2O)_{20}C_6H_{13}$ B-21

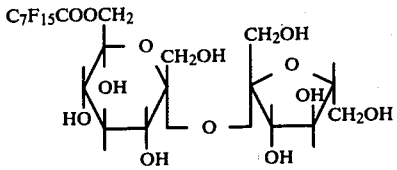

B-22

$C_8F_{17}SO_2NH(CH_2)_3\oplus N(CH_3)_3I^{\ominus}$ B-23

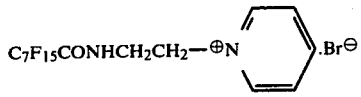

B-24

$H(CF_2)_8COOCH_2CH_2-\oplus N(CH_3)_2-C_2H_5\ Br^{\ominus}$ B-25

$C_7F_{15}CONH(CH_2)_3\oplus N(CH_3)_2-CH_2COO^{\ominus}$ B-26

$C_8F_{17}SO_2NHCH_2CH_2-\oplus N(CH_3)_2-CH_2CH_2COO^{\ominus}$ B-27

-continued

B-28

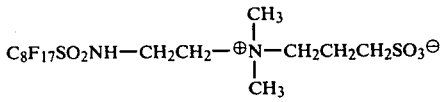

B-29

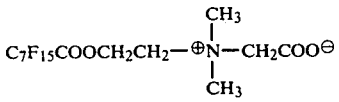

B-30

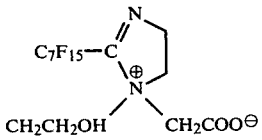

B-31

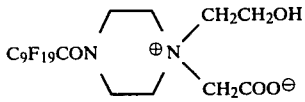

It is preferred to use the organic fluoro-compound represented by formula (II) in an amount of from 0.05 mg/m$^2$ to 200 mg/m$^2$, and particularly preferably from 0.1 mg/m$^2$ to 30 mg/m$^2$ in an outermost layer of the photographic light-sensitive material.

If further reduction of the surface resistivity is desired in practicing the present invention, it is preferred to use a film-forming water-soluble polymer having carboxylic acid groups together with the polymer and organic fluoro-compound according to the present invention.

The polymer having carboxylic acid groups which can be used in the present invention is required to have a molecular weight sufficient to provide a strong film under cross-linked state. Such a limit of the molecular weight differs from polymer to polymer, but it is generally within the range of from 5,000 to 500,000, and preferably from 10,000 to 200,000. The polymer having carboxylic acid groups which can be used with advantage in the present invention includes the following structural unit(s)

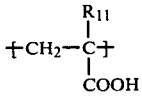

and/or

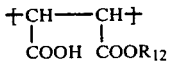

wherein $R_{11}$ represents a hydrogen atom or a methyl group; and $R_{12}$ represents a hydrogen atom or an alkyl group having 1 to 5 carbon atoms.

Specific examples of the polymers having carboxylic acid groups which can be advantageously used in the present invention are set forth below by reference to their structural units:

C-1

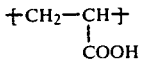

C-2

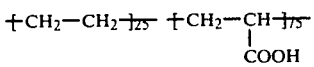

-continued

C-3

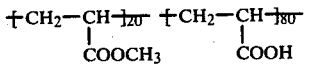

C-4

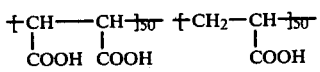

C-5

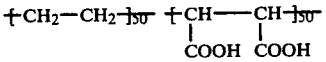

C-6

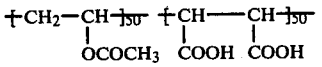

C-7

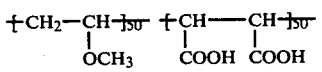

C-8

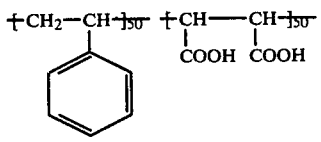

C-9

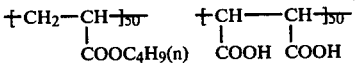

C-10

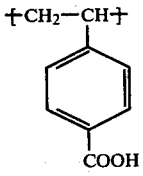

C-11

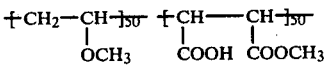

C-12

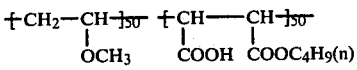

C-13

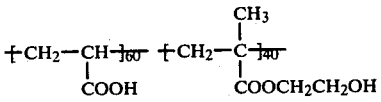

C-14

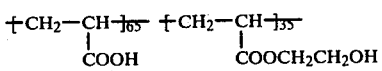

C-15

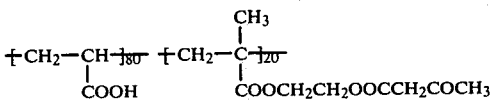

C-16

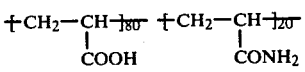

C-17

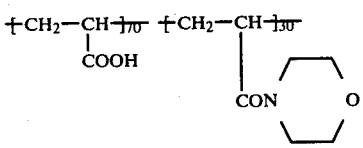

C-18

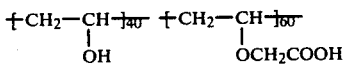

-continued

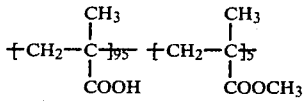

C-19

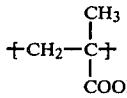

C-20

The polymer having carboxylic acid groups is preferably at least partially neutralized with an alkali. The alkali used is a base of an alkaline earth metal or an alkali metal or an organic base, and preferably it is sodium hydroxide or potassium hydroxide. A preferred degree of neutralization is such that at least about 50 mol% of the carboxylic acid group is neutralized, and the pH is preferably between 5.0 and 7.5. An amount of the polymer having carboxylic acid groups used in the present invention is from 50 mg/m$^2$ to 5 g/m$^2$, and preferably from 100 mg/m$^2$ to 1 g/m$^2$. It is preferred to add the polymer having carboxylic acid groups to the outermost layer of the photographic light-sensitive material.

In applying the compounds used in the present invention having an antistatic effect to a photographic light-sensitive material, they are dissolved in water or an organic solvent (e.g., methanol, isopropanol, acetone, etc.) or a mixture of both water and the above-described organic solvent, added to a coating solution of a layer of a photographic light-sensitive material, for example, of an outermost layer (e.g., a protective layer, a backing layer or both of them), and coated by dip coating, air knife coating, extrusion coating using a hopper as described in U.S. Pat. No. 2,681,294, or simultaneously with another photographic material constituting layer(s) as described in U.S. Pat. Nos. 3,508,947, 2,941,898, 3,526,528, etc., or else, a photographic layer is immersed in the solution of the compound.

The photographic light-sensitive material of the present invention comprises a support having thereon a hydrophilic colloid layer, for example, a light-sensitive silver halide emulsion layer, an intermediate layer, a surface protective layer, a backing layer, and the like.

Examples of the support for a photographic light-sensitive material of the present invention include a cellulose nitrate film, a cellulose acetate film, a cellulose acetate butyrate film, a cellulose acetate propionate film, a polystyrene film, a polyethylene terephthalate film, a polycarbonate film, a laminate thereof, a paper, etc. further, there are a baryta coated paper and a paper coated or laminated with an α-olefin polymer, such as polyethylene, polypropylene, or the like.

In the photographic light-sensitive material of the present invention, it is advantageous to use gelatin as a binder of each photographic material constituting layer. However, other hydrophilic colloids can also be used. Hydrophilic colloids which can be used include proteins, such as gelatin derivatives, graft polymers of gelatin and other polymers, albumin, and casein; cellulose derivatives, such as hydroxyethyl cellulose, carboxymethyl cellulose, and cellulose sulfuric acid ester; saccharide derivatives, such as sodium alginate, and starch derivatives; and a wide variety of synthetic hydrophilic high molecular weight substances, for example, homopolymers or copolymers such as polyvinyl alcohol, a partial acetal of polyvinyl alcohol, poly-N-vinyl pyrrolidone, polyacrylic acid, polymethacrylic acid, polyacrylamide, polyvinyl imidazole, and polyvinyl pyrazole.

Gelatin as used herein may be either lime-processed gelatin, acid-processed gelatin, or enzyme-processed gelatin as described in Bull. Soc. Sci. Phot. Japan, No. 16, page 30 (1966). In addition, a hydrolyzed product of gelatin and an enzyme-decomposition product of gelatin may also be used. As gelatin derivatives, those obtained by reacting gelatin with various kinds of compounds, for example, an acid halide, an acid anhydride, an isocyanate, a bromoacetic acid, an alkanesultone, a vinylsulfonamide, a maleinimido compound, a polyalkylene oxide, an epoxy compound, etc., can be used.

The silver halide emulsion of the photographic light-sensitive material used in the present invention is usually prepared by mixing a water-soluble silver salt (e.g., silver nitrate, etc.) solution with a water-soluble halide (e.g., potassium bromide, etc.) solution in the presence of a solution of water-soluble high molecular weight polymer such as gelatin. As the silver halide, there can be used mixed silver halides such as silver chlorobromide, silver bromoiodide, silver chloroiodobromide, etc., as well as silver chloride and silver bromide. These silver halide grains can be formed by known processes. For instance, it is useful to prepare them according to a single jet process, a double jet process, or a controlled double jet process, etc. Such photographic emulsions are described in T. H. James & C. E. K. Mees, *The Theory of the Photographic Process,* 4th Ed. (published by Macmillan Co., 1977), P. Glafkides, *Chimie Photographique* (published by Paul Montel), etc., and can be prepared according to various processes commonly used, such as an ammoniacal process, a neutral process, an acidic process, etc.

The silver halide emulsion is usually subjected to chemical sensitization, although the so-called primitive emulsion, which is not subjected to chemical sensitizaton, can be used. For this chemical sensitization, those methods as described in Glafkides, ibid., and in H. Frieser, *Die Grundlagen der Photographischen Prozesse mit Silberhalogeniden* (Akademishe Verlagsgesellschaft, 1968) can be used. That is, a sulfur sensitization method in which a compound containing a sulfur capable of reacting with a silver ion or active gelatin is used, a reduction sensitization method in which a reducing agent is used, a noble metal sensitization method in which a gold compound or other noble metal compound is used, and the like, can be used alone or in combinations thereof. Examples of the sulfur sensitizing agents which can be used include a thiosulfate, a thiourea, a thiazole, a rhodanine, and the like. Specific examples of these compounds are described, for example, in U.S. Pat. Nos. 1,574,944, 2,410,689, 2,278,947, 2,728,668, 3,656,955, 4,032,928 and 4,067,740. Examples of the reduction sensitizing agents which can be used include a stannous salt, an amine, a hydrazine derivative, formamidinesulfinic acid, a silane compound, and the like. Specific examples of these compounds are described, for example, in U.S. Pat. Nos. 2,487,850, 2,419,974, 2,518,698, 2,983,609, 2,983,610, 2,694,637, 3,930,867 and 4,054,458. For the noble metal sensitization, a gold complex salt and a complex salt of a metal belonging to Group VIII of the Periodic Table, such as platinum, iridium, palladium, etc., can be used. Specific examples of these compounds are described, for example, in U.S. Pat. Nos. 2,399,083 and 2,448,060, British Pat. No. 618,061.

The photographic emulsion may be subjected, if desired, to spectral sensitization or supersensitization using cyanine, merocyanine, carbocyanine or like polymethine sensitizing dyes, alone or in combination, or in further combination with styryl dyes.

To the photographic emulsion of the photographic light-sensitive material used in the invention there can be added various compounds in order to prevent the formation of fog or stabilize the photographic properties in the production, storage or processing of the light-sensitive material. As such compounds, a wide variety of compounds which are known as anti-foggants or stabilizers can be used, viz., an azole, such as a benzothiazolium salt, a nitroindazole, a nitrobenzimidazole, a chlorobenzimidazole, a bromobenzimidazole, a mercaptothiazole, a mercaptobenzothiazole, a mercaptobenzimidazole, a mercaptothiadiazole, an aminotriazole, a benzotriazole, a nitrobenzotriazole, and a mercaptotetrazole (particularly, 1-phenyl-5-mercaptotetrazole); a mercaptopyrimidine; a mercaptotriazine, a thioketo compound, such as an oxazolinethione; an azaindene, such as a triazaindene, a tetraazaindene (particularly, a 4-hydroxy-substituted(1,3,3a,7)tetraazaindene), and a pentaazaindene; benzenethiosulfonic acid, benzenesulfinic acid, benzenesulfonic acid amide, etc. For example, the compounds described in U.S. Pat. Nos. 3,954,474 and 3,982,947, Japanese patent publication No. 28660/77, etc., can be used.

The photographic emulsion layer of the photographic light-sensitive material of the present invention may contain a color forming couplers, that is, a compound capable of forming a dye upon oxidative coupling with an aromatic primary amine developing agent (for example, a phenylenediamine derivative, an aminophenol derivative, etc.) in the color development processing. For instance, magenta couplers include 5-pyrazolone couplers, pyrazolobenzimidazole couplers, cyanoacetylcoumarone couplers, open chain acylacetonitrile couplers, etc.; yellow couplers include acylacetamide couplers (for example, benzoylacetanilides, pivaloylacetanilides, etc.), etc.; and cyan couplers include naphthol couplers, phenol couplers, etc.

Non-diffusible couplers which contain a hydrophobic group, called a ballast group, in the molecule thereof are preferred as couplers. Couplers can be 4-equivalent or 2-equivalent couplers. In addition, colored couplers providing a color correction effect, or couplers which release development inhibitors upon development (so-called DIR couplers) can also be used. Furthermore, non-color-forming DIR coupling compounds which provide a colorless product and release a development inhibitor upon the coupling reaction can be incorporated.

The photographic light-sensitive material of the present invention can contain in the photographic emulsion layer and other hydrophilic colloid layers, an inorganic or organic hardening agent. For example, a chromium salt (for example, chromium alum and chromium acetate, etc.), an aldehyde (for example, formaldehyde, glyoxal, glutaraldehyde, etc.), an N-methylol compound (for example, dimethylolurea, methyloldimethylhydantoin, etc.), a dioxane derivative (for example, 2,3-dihydroxydioxane, etc.), an active vinyl compound (for example, 1,3,5-triacryloylhexahydro-s-triazine, 1,3-vinylsulfonyl-2-propanol, etc.), an active halogen compound (for example, 2,4-dichloro-6-hydroxy-s-triazine, etc.), a mucohalogenic acid (for example, mucochloric acid, mucophenoxychloric acid, etc.), and the like can be used alone or in combination thereof.

The above-described hardening agents and other hardening agents which can be used in the present invention are described, for example, in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827 and 3,543,292, British Pat. Nos. 676,628, 825,544 and 1,270,578, German Pat. Nos. 872,153 and 1,090,427, Japanese patent publication Nos. 7133/59 and 1872/71 and Research Disclosure, Vol. 176, page 26 (December, 1978), etc.

To the photographic material constituting layers of the present invention there may be added surface active agents alone or in combination. They are used as coating aids, but, in some cases, they are used for other purposes, e.g., for the improvement of emulsion dispersion, sensitization and other photographic properties, to provide a desired adjustment in the triboelectric charging propensity of the surface, etc.

These surface active agents are classified into natural surface active agents such as saponin; nonionic surface active agents such as of the alkylene oxide series, glycerin series, glycidol series, etc.; cationic surface active agents such as higher alkylamines, quaternary ammonium salts, heterocyclic compounds (e.g., pyridine, etc.), phosphonium compounds, sulfonium compounds, etc.; anionic surface active agents having an acidic group such as a carboxylic acid group, a sulfonic acid group, a phosphoric acid group, a sulfuric ester group, a phosphoric acid ester group, etc.; amphoteric surface active agents such as aminoacids, aminosulfonic acids, aminoalcohol sulfuric or phosphoric esters, etc.

Examples of usable surface active agents are described in patents such as U.S. Pat. Nos. 2,271,623, 2,240,472, 2,288,226, 2,739,891, 3,068,101, 3,158,484, 3,201,253, 3,210,191, 2,294,540, 3,415,649, 3,441,413, 3,442,654, 3,475,174, 3,545,974, 3,666,478 and 3,507,660, British Pat. No. 1,198,450, etc.

The photographic light-sensitive material of the present invention can contain in its photographic layers a polymer latex described in U.S. Pat. Nos. 3,411,911 and 3,411,912, Japanese patent publication No. 5331/70, etc., and, as a plasticizer, polyols as described, for example, in U.S. Pat. Nos. 2,960,404, 3,042,524, 3,520,694, 3,656,956, 3,640,721, etc.

Also, as a matting agent, silver halide, silica, strontium sulfate, barium sulfate, polymethyl methacrylate, etc., may be used.

The present invention has overcome the problems caused by electrostatic charges generated during production of photographic light-sensitive materials and/or upon use thereof.

For example, the present invention remarkably reduces the generation of static marks formed by contact between an emulsion-coated surface and a backing layer of a photographic light-sensitive material, by contact between emulsion-coated surfaces and by contact with substances with which photographic light-sensitive materials often come into contact, such as rubber, metal, plastics, fluorescent-sensitizing paper, etc.

It is particularly surprising that when the polymers and compounds of the present invention are applied to at least one layer of a photographic light-sensitive material as shown in the following Examples, both surface resistivity and charge are reduced.

Also, the compounds to be used in the present invention extremely effectively prevent electrostatic charging, even at low humidity, e.g., generated when loading photographic film into a cassette or into a camera, and when photographing continuously at high speed using large amounts of film using an automatic photographing machine as with X-ray films. In addition, the antistatic effect does not deteriorate with the passage of time, or due to friction.

The present invention is illustrated below in more detail by examples of the present invention, which, however, are not intended to limit the present invention.

EXAMPLE 1

Samples (1) to (16), comprising a protective layer, an emulsion layer, a polyethylene terephthalate film support, an emulsion layer, and a protective layer, in the sequence listed, were prepared by coating and drying in a conventional manner. The composition of each layer is shown below.

Emulsion Layer

Binder: 3 g/m$^2$ of gelatin

Coated Silver Amount: 4 g/m$^2$

Silver Halide Composition: AgI (1.5 mol%)+AgBr (98.5 mol%)

Hardening Agent: 2,4-dichloro-6-hydroxy-1,3,5-triazine sodium salt (0.4 g/100 g gelatin)

Anti-Fogging Agent: 1-phenyl-5-mercaptotetrazole (0.5 g/100 g Ag)

Protective Layer

Binder: 1.7 g/m$^2$ of gelatin

Hardening Agent: 2-hydroxy-4,6-dichloro-s-triazine sodium salt (0.4 g/100 g binder)

As shown in Table 1 below, Sample (1) had the composition described above, whereas in Samples (2) to (4) Compound A-1 was added to the emulsion layers in addition to the components of Sample (1). In Samples (5) to (8), Compounds B-14, B-17, B-23, and B-29, respectively, were added to the protective layer in addition to the components of Sample (3). In Samples (9) to (12), Compound C-1 (pH adjusted to 6 with sodium hydroxide) was added in addition to the indicated A polymer and B compound. In Samples (13) and (14), Compounds constituted of the same polymeric unit as A-1, except that the molecular weights are 5,000 and 3,000,000, respectively, were added, respectively. In Samples (15) and (16), alkylpolyethyleneoxide and saponin were added, respectively. With respect to these samples, the surface resistivity, the charge and the degree of screen deterioration were evaluated by the methods set forth below. The results obtained are shown in Table 2 below.

(i) Measurement of Surface Resistivity

A samle piece was moisture-conditioned at 25° C. and 30% RH for 1 hour and then placed between brass electrodes having a 0.14 cm electrode gap and a 10 cm length (portions thereof in contact with the sample piece being made of stainless steel), and the resistivity value after 1 minute was determined using an electrometer (TR-8651 made by Takeda Riken Co.). The test was conducted at 25° C., 30% RH, whereafter surface resistivity was calculated according to Ohm's law. The smaller the value of surface resistivity, the better the antistatic property.

(ii) Measurement of Charge

A sample piece of 3 cm×17 cm was rolled with a rubber roller under a load of 380 g at a speed of 25 cm/sec, and the charge of the sample was measured in a Faraday gauge.

(iii) Measurement of Degree of Screen Deterioration

A sample piece and LT-II (an X-ray phosphor screen produced by DAI NIPPON TORYO Co., Ltd.) were moisture-conditioned for one day at 30° C. and 80% RH, and 1,000 pieces of film samples were passed through a cassette with LT-II under identical conditions, and X-rayed to check for the presence of any stain or blur.

TABLE 1

| Sample No. | Contents of Samples (antistatic agents used and the amounts thereof added in units of mg/m$^2$ shown in parentheses) | | |
|---|---|---|---|
| | Sulfonic Acid Polymer | Fluorine Type Surface Active Agent | Carboxylic Acid Polymer |
| No. 1 (Control) | — | — | — |
| No. 2 (Present Invention) | A-1 (200) | — | — |
| No. 3 (Present Invention) | A-1 (400) | — | — |
| No. 4 (Present Invention) | A-1 (800) | — | — |
| No. 5 (Present Invention) | A-1 (500) | B-14 (2) | — |
| No. 6 (Present Invention) | A-1 (500) | B-17 (2) | — |
| No. 7 (Present Invention) | A-1 (500) | B-23 (2) | — |
| No. 8 (Present Invention) | A-1 (500) | B-29 (2) | — |
| No. 9 (Present Invention) | A-3 (500) | B-6 (2) | — |
| No. 10 (Present Invention) | A-1 (500) | — | C-1 (200) |
| No. 11 (Present Invention) | A-1 (500) | B-28 (2) | C-1 (200) |
| No. 12 (Present Invention) | A-3 (500) | B-28 (2) | C-1 (200) |
| No. 13 (Comparison) | A-1' (400) | — | — |
| No. 14 (Comparison) | A-1'' (400) | — | — |
| No. 15 (Comparison) | $C_{12}H_{25}O-(CH_2CH_2O)_{10}H$ | — | — |
| No. 16 (Comparison) | Saponin | — | — |

A-1: Mw 300,000

A-1' and A-1'': In comparison samples numbers 13 and 14 represent a polymer constituted of the same polymeric unit as A-1, except that the molecular weights were 5,000 and 3,000,000, respectively, whereas the molecular weight of A-1 in the samples in Table 1 was 300,000.

A-3: Mw 300,000

TABLE 2

| Sample No. | Results of Measurement | | |
|---|---|---|---|
| | Surface Resistivity | Charge* | Screen Deterioration** |
| 1 | $2.0 \times 10^{14}$ | $5.0 \times 10^{-7}$ | A |
| 2 | $3.5 \times 10^{13}$ | $8.0 \times 10^{-8}$ | A |
| 3 | $8.0 \times 10^{12}$ | $4.5 \times 10^{-8}$ | A |
| 4 | $3.0 \times 10^{12}$ | $2.0 \times 10^{-8}$ | A |
| 5 | $8.0 \times 10^{12}$ | $-5.0 \times 10^{-8}$ | A |
| 6 | $8.0 \times 10^{12}$ | $-3.0 \times 10^{-8}$ | A |
| 7 | $8.0 \times 10^{12}$ | $-7.0 \times 10^{-8}$ | B |
| 8 | $8.0 \times 10^{12}$ | $-2.5 \times 10^{-8}$ | A |
| 9 | $7.5 \times 10^{12}$ | $-2.0 \times 10^{-8}$ | A |

TABLE 2-continued

| Sample No. | Surface Resistivity | Charge* | Screen Deterioration** |
|---|---|---|---|
| | Results of Measurement | | |
| 10 | $1.5 \times 10^{12}$ | $2.0 \times 10^{-8}$ | A |
| 11 | $1.5 \times 10^{12}$ | $-3.5 \times 10^{-8}$ | A |
| 12 | $1.5 \times 10^{12}$ | $-4.0 \times 10^{-8}$ | A |
| 13 | $6.0 \times 10^{13}$ | $1.5 \times 10^{-7}$ | A |
| 14 | Cannot be coated | — | — |
| 15 | $1.8 \times 10^{13}$ | $7.5 \times 10^{-7}$ | C |
| 16 | $2.0 \times 10^{14}$ | $-3.5 \times 10^{-7}$ | A |

*"—" sign indicates a negative charge
**Screen Deterioration A: Strain or blur was not observed. B: Stain and blur were considerably observed. C: Stain and blur were observed throughout.

As is apparent from the results set forth in Table 2, the surface resistivity, charge and screen deterioration properties are all relatively good in the samples according to the present invention.

EXAMPLE 2

Samples (21) to (30) comprising a cellulose triacetate support, an antihalation layer, a red-sensitive layer, an interlayer, a green-sensitive layer, a yellow filter layer, a blue-sensitive layer and a protective layer in this order were prepared by coating and drying in a conventional manner. The composition of each layer is shown below.

Antihalation Layer

Binder: 4.4 g/m$^2$ of gelatin

Hardener: bis(vinylsulfonylmethyl)ether (5 g/100 g binder)

Coating Aid: 4 mg/m$^2$ of sodium dodecylbenzenesulfonate

Halation-Preventing Component: 0.4 g/m$^2$ of black colloidal silver

Red-Sensitive Layer

Binder: 7 g/m$^2$ of gelatin

Hardener: 2-hydroxy-4,6-dichloro-s-triazine sodium salt (0.7 g/100 g binder)+bis(vinylsulfonylmethyl)ether (2 g/100 g binder)

Coating Aid: 10 mg/m$^2$ of sodium dodecylbenzenesulfonate

Coated Silver Amount: 3.1 g/m$^2$

Silver Halide Composition: 2 mol% of AgI+98 mol% of AgBr

Anti-Fogging Agent: 4-hydroxy-6-methyl-1,3,3a,7-tetraazaindene (0.9 g/100 g Ag)

Color Former: 1-hydroxy-4-(2-acetylphenyl)azo-N-[4-(2,4-di-tert-amylphenoxy)butyl]-2-naphthamide (38 g/100 g Ag)

Sensitizing Dye: anhydro-5,5'-dichloro-9-ethyl-3,3'-di(3-sulfopropyl)thiacarbocyanine hydroxide pyridinium salt (0.3 g/100 g Ag)

Interlayer

Binder: 2.6 g/m$^2$ of gelatin

Hardener: bis(vinylsulfonylmethyl)ether (6 g/100 g binder)

Coating Aid: 12 mg/m$^2$ of sodium dodecylbenzenesulfonate

Green-Sensitive Layer

Binder: 6.4 g/m$^2$ of gelatin

Hardener: 2-hydroxy-4,6-dichloro-s-triazine sodium salt (0.7 g/100 g binder)+bis(vinylsulfonylmethyl)ether (2 g/100 g binder)

Coating Aid: 9 mg/m$^2$ of sodium dodecylbenzenesulfonate

Coated Silver Amount: 2.2 g/m$^2$

Silver Halide Composition: 3.3 mol% of AgI+96.7 mol% of AgBr

Stabilizer: 4-hydroxy-6-methyl-1,3,3a,7-tetraazaindene (0.6 g/100 g Ag)

Color Former: 1-(2,4,6-trichlorophenyl)-3-[3-(2,4-di-tert-amylphenoxy)acetamido]-4-(4-methoxyphenyl-)azo-5-pyrazolone (37 g/100 g Ag)

Sensitizing Dye: anhydro-5,5'-diphenyl-9-ethyl-3,3'-di(2-sulfoethyl)oxacarbocyanine hydroxide pyridinium salt (0.3 g/100 g Ag)

Yellow Filter Layer

Binder: 2.3 g/m$^2$ of gelatin

Filter Component: 0.7 g/m$^2$ of yellow colloidal silver

Hardener: bis(vinylsulfonylmethyl)ether (5 g/100 g binder)

Surface Active Agent: 7 mg/m$^2$ of bis(2-ethylhexyl)-2-sulfonatosuccinate sodium salt Blue-Sensitive Layer Binder: 7 g/m$^2$ of gelatin Hardener: 2-hydroxy-4,6-dichloro-s-triazine sodium salt (0.7 g/100 g binder)+bis(vinylsulfonylmethyl)ether (2 g/100 g binder)

Coating Aid: 8 mg/m$^2$ of sodium dodecylbenzenesulfonate

Coated Silver Amount: 2.2 g/m$^2$

Silver Halide Composition: 3.3 mol% of AgI+96.7 mol% of AgBr

Stabilizing Agent: 4-hydroxy-6-methyl-1,3,3a,7-tetraazaindene (0.4 g/100 g Ag)

Color Former: 2'-chloro-5'-[2-(2,4-di-tert-amylphenoxy)butyramido]-α-(5,5'-dimethyl-2,4-dioxo-3-oxazolidinyl)-α-(4-methoxybenzoyl)-acetanilide (45 g/100 g Ag)

Protective Layer

Binder: 2 g/m$^2$ of gelatin+0.3 g/m$^2$ of styrenemaleic anhydride (1:1 molar) copolymer (mean molecular weight: about 100,000)

Hardener: bis(vinylsulfonylmethyl)ether (5 g/100 g binder)

Coating Aid: 5 mg/m$^2$ of sodium dioctylsulfosuccinate

The polymers according to the present invention were added to the above-described composition as described below, coated, and dried. The films thus-prepared were moisture-conditioned at 25° C. and 30% RH for 1 hour, and then the surface resistivity and the amount of static marks generated were measured in the manner as described in Example 1, and as described below, respectively. The results of measurement are shown in Table 4 below.

Measurement of Generation of Static Marks

The surface of a photographic film sample and a white rubber plate were superposed one over the other and pressure applied to the assembly by applying a rubber roller to the white rubber plate under the conditions: 25° C. and 40% RH. The white rubber plate was then removed, and the sample developed, fixed and washed with water to examine the amount of static marks generated.

The results of examining the samples of Table 3 are shown in Table 4.

TABLE 3

| Sample No. | Contents of Samples (antistatic agents used and amounts added in units of mg/m$^2$ shown in parentheses) | | |
|---|---|---|---|
| | Sulfonic Acid Polymer Added to Emulsion Layer | Fluorine Type Surface Active Agent Added to Protective Layer | Carboxylic Acid Polymer Added to Protective Layer |
| 21 (Control) | — | — | — |
| 22 (Present Invention) | A-1 (300) | — | — |
| 23 (Present Invention) | A-1 (600) | — | — |
| 24 (Present Invention) | A-1 (1,000) | — | — |
| 25 (Present Invention) | A-1 (600) | B-17 (2) | — |
| 26 (Present Invention) | A-1 (600) | B-29 (4) | — |
| 27 (Present Invention) | A-3 (600) | — | C-1 (200) |
| 28 (Present Invention) | A-3 (600) | B-28 (2) | C-1 (200) |
| 29 (Present Invention) | A-1 (600) | B-28 (2) | C-1 (200) |
| 39 (Comparison) | Saponin | — | — |

TABLE 4

| Sample No. | Results of Measurement | |
|---|---|---|
| | Surface Resistivity | Amount of Static Marks Generated** |
| 21 | $3.5 \times 10^{13}$ | E |
| 22 | $5.5 \times 10^{12}$ | D |
| 23 | $9.5 \times 10^{11}$ | C |
| 24 | $3.5 \times 10^{11}$ | B |
| 25 | $9.5 \times 10^{11}$ | B |
| 26 | $9.5 \times 10^{11}$ | B |
| 27 | $2.0 \times 10^{11}$ | B |
| 28 | $2.0 \times 10^{11}$ | A |
| 29 | $2.0 \times 10^{11}$ | A |
| 30 | $3.0 \times 10^{13}$ | D |

**The amount of static marks generated was evaluated by the following 5 steps.
A: Static mark generation was not observed.
B: Static mark generation was slightly observed.
C: Static mark generation was considerably observed.
D: Static mark generation was significantly observed.
E: Static mark generation was observed throughout.

It is apparent from the results set forth in Table 4 above that the antistatic property is remarkably improved by use of the polymers according to the present invention.

While the invention has been described in detail and with reference to specific embodiments thereof, it will be apparent to one skilled in the art that various changes and modifications can be made therein without departing from the spirit and scope thereof.

What is claimed is:

1. A photographic light-sensitive material comprising a support having thereon a silver halide emulsion layer, said material including at least one hydrophilic colloid layer containing at least 0.1 g/m$^2$ of a water-soluble polymer having a molecular weight of from 10,000 to 500,000 and consisting essentially of a repeating unit represented by formula (I)

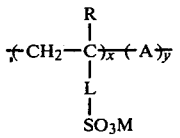

(I)

wherein R represents a hydrogen atom, a halogen atom, or an alkyl group; L represents an arylene group, an arylenealkylene group, an alkylene group or a single chemical bond; M represents a hydrogen atom, an ammonium ion, or an alkali metal ion; x represents from 10 to 100 mol%; y represents from 0 to 90 mol%; and A represents a copolymerized monomer unit selected from an ethylenically unsaturated monocarboxylic acid or dicarboxylic acid, an ester of an ethylenically unsaturated monocarboxylic acid or dicarboxylic acid, an ethylenically unsaturated ester of a monoaliphatic acid, styrene, α-methylstyrene, acrylonitrile, acrylamide, methacrylamide, N-vinyl pyrrolidone, ethylene, propylene, or a diene, wherein said photographic material further contains an organic fluorocompound represented by formula (II)

$$(Cf)(Y)_n \qquad \text{(II)}$$

wherein (Cf) represents an n-valent group containing at least three fluorine atoms and at least three carbon atoms; n represents an integer of 1 or 2; and (Y) represents a moiety selected from the group consisting of

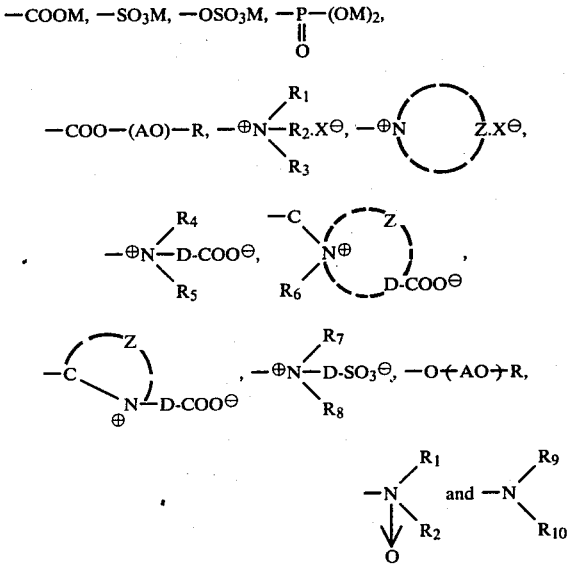

wherein M represents a hydrogen atom, a cation or a hydrocarbon group having from 1 to 18 carbon atoms; —(AO)— represents a polyalkylene oxide group having a degree of polymerization of from 2 to 100 and selected from the group consisting of polyoxyethylene, polyoxypropylene and a polyoxyethylene-polyoxypropylene block copolymer; R represents a hydrogen, atom an alkyl group having from 1 to 18 carbon atoms or an aryl group; $R_1$, $R_2$, $R_3$, $R_4$, $R_5$, $R_6$, $R_7$ and $R_8$ each represents an alkyl group having from 1 to 4 carbon atoms or a hydroxyalkyl group having from 1 to 4 carbon atoms; $R_9$ and $R_{10}$ each represents a hydrogen atom, an alkyl group having from 1 to 4 carbon atoms or a hydroxyalkyl group having from 1 to 4 carbon atoms; X represents a halogen atom or an R—O—$SO_2$—$O^{\ominus}$ group; Z represents an atom or an atomic group forming a 5-membered or 6-membered ring together with the N atom; and D represents an alkylene group having 1 to 5 carbon atoms and a film forming water soluble polymer having carboxylic acid groups selected from

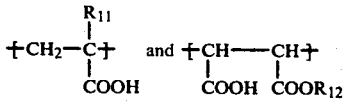

wherein $R_{11}$ represents a hydrogen atom or a methyl group; and $R_{12}$ represents a hydrogen atom or an alkyl group having from 1 to 5 carbon atoms.

2. A photographic light-sensitive material as in claim 1, wherein the divalent connecting group represented by L is an arylene group having from 6 to 10 carbon atoms, an arylenealkylene group having from 7 to 12 carbon atoms, an alkylene group having from 1 to 6 carbon atoms, —$COOR_1$— or —$CONHR_1$—, wherein $R_1$ represents an alkylene group having from 1 to 6 carbon atoms, an arylene group having from 6 to 10 carbon atoms, or an arylenealkylene group having from 7 to 12 carbon atoms.

3. A photographic light-sensitive material as in claim 1, wherein the copolymerizable ethylenically unsaturated monomer forming A is acrylic acid, methacrylic acid, styrene, methyl methacrylate, acrylamide, or N-vinyl pyrrolidone.

4. A photographic light-sensitive material as in claim 1, wherein the water-soluble polymer having a repeating unit represented by formular (I) is selected from Polymer A-1 to Polymer A-10

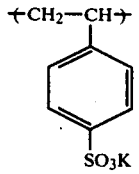

A-1

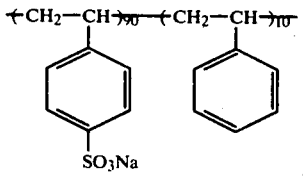

A-2

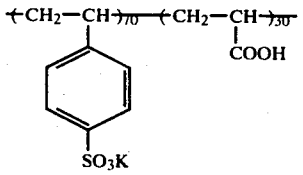

A-3

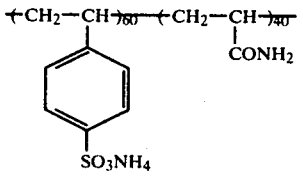

A-4

-continued

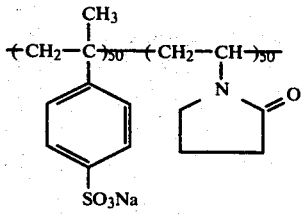

A-5

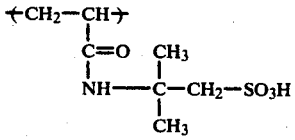

A-6

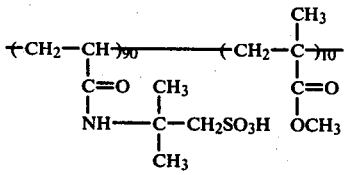

A-7

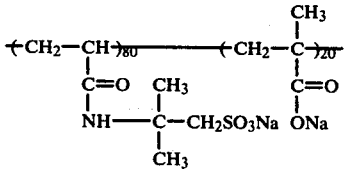

A-8

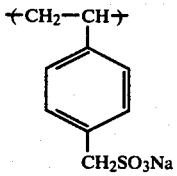

A-9

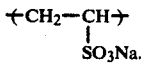

A-10

5. A photographic light-sensitive material as in claim 1, 2, 3, or 4, wherein the water-soluble polymer having a repeating unit represented by formula (I) is present in an amount of from 0.1 g/$m^2$ to 1.0 g/$m^2$.

6. A photographic light-sensitive material as in claim 1, 2, 3, or 4, wherein the water-soluble polymer having a repeating unit represented by formula (I) is present in an emulsion layer or a layer adjacent thereto.

7. A photographic light-sensitive material as in claim 1, wherein the organic fluoro-compound represented by formula (II) is present in an outermost layer.

8. A photographic light-sensitive material as in claim 7, wherein the organic fluoro-compound represented by formula (II) is present in an amount of from 0.05 mg/$m^2$ to 200 mg/$m^2$.

9. A photographic light-sensitive material as in claim 7, wherein the organic fluoro-compound represented by formula (II) is present in an amount of from 0.1 mg/$m^2$ to 30 mg/$m^2$.

10. A photographic light-sensitive material as in claim 9, wherein the outermost layer is a surface protective layer.

11. A photographic light-sensitive material as in claim 1, wherein the molecular weight of the polymer having carboxylic acid groups is in the range of from 5,000 to 500,000.

12. A photographic light-sensitive material as in claim 1, wherein the molecular weight of the polymer having carboxylic acid groups is in the range of from 10,000 to 200,000.

13. A photographic light-sensitive material as in claim 1, wherein the polymer having carboxylic acid groups is selected from Polymer C-1 to Polymer C-20

C-1 $+CH_2-CH+$ (COOH)

C-2 $+CH_2-CH_2\rfloor_{25}\ +CH_2-CH\rfloor_{75}$ (COOH)

C-3 $+CH_2-CH\rfloor_{20}\ +CH_2-CH\rfloor_{80}$ ($COOCH_3$; COOH)

C-4 $+CH-CH\rfloor_{50}\ +CH_2-CH\rfloor_{50}$ (COOH COOH; COOH)

C-5 $+CH_2-CH_2\rfloor_{50}\ +CH-CH\rfloor_{50}$ (COOH COOH)

C-6 $+CH_2-CH\rfloor_{50}\ +CH-CH\rfloor_{50}$ ($OCOCH_3$; COOH COOH)

C-7 $+CH_2-CH\rfloor_{50}\ +CH-CH\rfloor_{50}$ ($OCH_3$; COOH COOH)

C-8 $+CH_2-CH\rfloor_{50}\ +CH-CH\rfloor_{50}$ (COOH COOH)

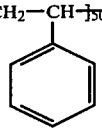

C-9 $+CH_2-CH\rfloor_{50}\ +CH-CH\rfloor_{50}$ ($COOC_4H_9(n)$; COOH COOH)

C-10 $+CH_2-CH+$

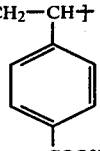

COOH

C-11 $+CH_2-CH\rfloor_{50}\ +CH-CH\rfloor_{50}$ ($OCH_3$; COOH $COOCH_3$)

C-12 $+CH_2-CH\rfloor_{50}\ +CH-CH\rfloor_{50}$ ($OCH_3$; COOH $COOC_4H_9(n)$)

-continued

C-13 $+CH_2-CH\rfloor_{60}\ +CH_2-C\rfloor_{40}$ (COOH; $CH_3$; $COOCH_2CH_2OH$)

C-14 $+CH_2-CH\rfloor_{65}\ +CH_2-CH\rfloor_{35}$ (COOH; $COOCH_2CH_2OH$)

C-15 $+CH_2-CH\rfloor_{80}\ +CH_2-C\rfloor_{20}$ (COOH; $CH_3$; $COOCH_2CH_2OOCCH_2COCH_3$)

C-16 $+CH_2-CH\rfloor_{80}\ +CH_2-CH\rfloor_{20}$ (COOH; $CONH_2$)

C-17 $+CH_2-CH\rfloor_{70}\ +CH_2-CH\rfloor_{30}$ (COOH; CON O)

C-18 $+CH_2-CH\rfloor_{40}\ +CH_2-CH\rfloor_{60}$ (OH; $OCH_2COOH$)

C-19 $+CH_2-C\rfloor_{95}\ +CH_2-C\rfloor_{5}$ (COOH; $CH_3$; $CH_3$; $COOCH_3$)

C-20 $+CH_2-C+$ ($CH_3$; COOH)

14. A photographic light-sensitive material as in claim 1, wherein the polymer having carboxylic acid groups is a polymer in which at least 50 mol% of the carboxylic acid group is neutralized.

15. A photographic light-sensitive material as in claim 1, wherein the polymer having carboxylic acid groups is present in an amount of from 50 $mg/m^2$ to 5 $g/m^2$.

16. A photographic light-sensitive material as in claim 1, wherein the polymer having carboxylic acid groups is present in an amount of from 100 $mg/m^2$ to 1 $g/m^2$.

17. A photographic light-sensitive material as in claim 1, wherein the polymer having carboxylic acid groups is present in an outermost layer.

18. A photographic light-sensitive material as in claim 17, wherein the outermost layer is a surface protective layer.

19. A photographic light-sensitive material as in claim 9, wherein the outermost layer contains the film-forming water-soluble polymer having carboxylic acid groups.

* * * * *